United States Patent [19]

Matoba

[11] Patent Number: 5,000,642

[45] Date of Patent: Mar. 19, 1991

[54] AUTOMATED MULTISTORY PARKING SYSTEM

[75] Inventor: Nobuhito Matoba, Marietta, Ga.

[73] Assignee: Matex Gear and Pump Co., Inc., Marietta, Ga.

[21] Appl. No.: 351,592

[22] Filed: May 15, 1989

Related U.S. Application Data

[63] Continuation-in-part of Ser. No. 185,884, Apr. 25, 1988, abandoned.

[51] Int. Cl.[5] ..... B65G 65/00

[52] U.S. Cl. ..... 414/260; 414/232

[58] Field of Search ..... 414/227-232, 414/252-256, 258-260, 264, 280, 661, 786; 254/93 HP, 89 H; 198/741, 747; 104/165, 172.3

[56] References Cited

U.S. PATENT DOCUMENTS

| | | | |
|---|---|---|---|
| 2,028,391 | 1/1936 | Harnischfeger | 414/247 |
| 2,113,986 | 4/1938 | Kent | 414/247 X |
| 2,428,856 | 10/1947 | Sinclair | 414/259 |
| 2,696,921 | 12/1954 | Desjardins | 414/259 X |
| 2,754,014 | 7/1956 | Santachi | 414/258 |
| 2,994,445 | 8/1961 | Roth | 414/249 |
| 3,063,675 | 11/1962 | Allen | 254/93 HP X |
| 3,211,425 | 10/1965 | Greulich et al. | 254/93 HP X |
| 3,669,292 | 6/1972 | Tuura | 254/93 HP X |
| 4,103,787 | 8/1978 | Salloum | 414/259 X |
| 4,690,611 | 9/1987 | Nobuhara | 414/295 X |

FOREIGN PATENT DOCUMENTS

| | | |
|---|---|---|
| 1585920 | 2/1970 | France . |
| 627713 | 11/1961 | Italy . |

*Primary Examiner*—David A. Bucci
*Attorney, Agent, or Firm*—David P. Kelley

[57] ABSTRACT

A multistory parking garage has an elevator constrained to move vertically within a central core to reach a plurality of vertically stacked parking cells. A vehicle transport carriage mounted on the elevator rolls the vehicle from the elevator into an empty parking cell and returns to the elevator or rolls a vehicle from the parking cell onto the elevator. The carriage includes resilient members for engaging and disengaging the underside of the vehicle without damage thereto.

2 Claims, 5 Drawing Sheets

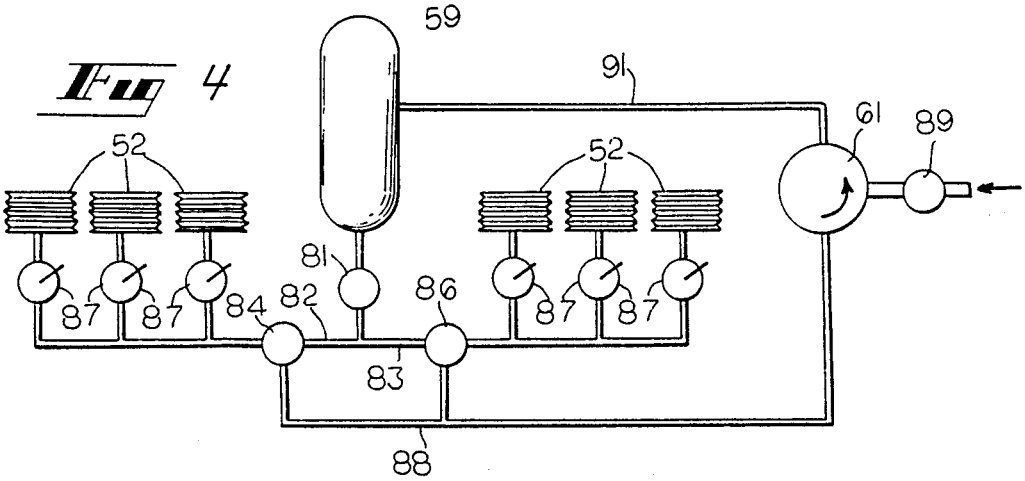
Fig 4
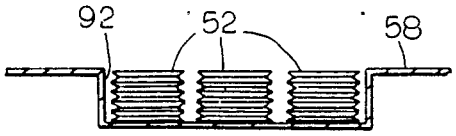
Fig 5
Fig 7
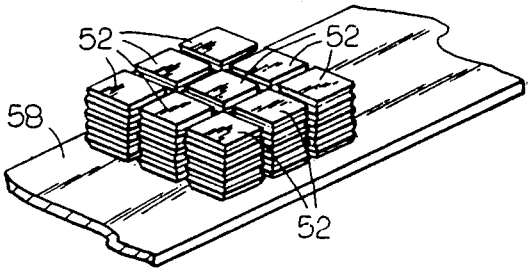
Fig 6A
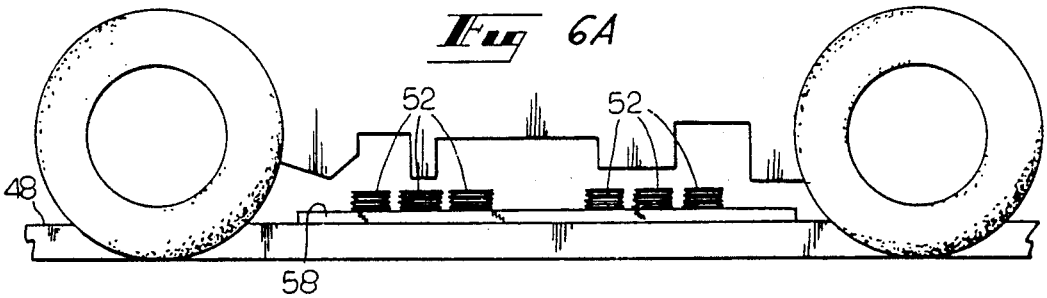
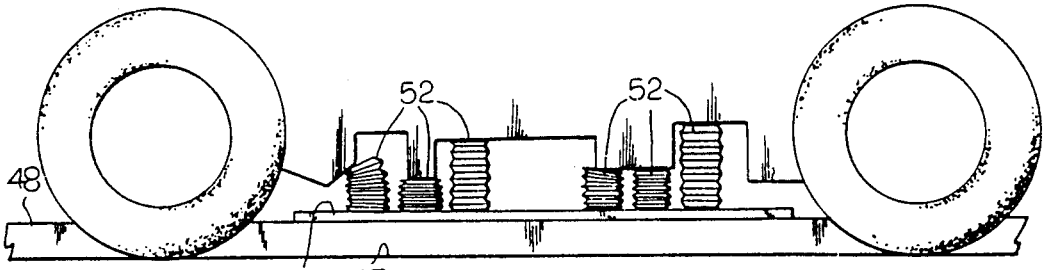
Fig 6B

AUTOMATED MULTISTORY PARKING SYSTEM

This application is a continuation-in-part of U.S. patent application Ser. No. 07/185,884 of Nobuhito Matoba, filed Apr. 25, 1988, now abandoned.

BACKGROUND OF THE INVENTION

This invention relates to multistory parking garages for automobiles, more particularly, the invention relates to a multistory parking garage which moves vehicles to and from designated parking cells automatically, in a simple, reliable manner.

In urban areas particularly, but also in suburban areas, the growing commercialization of available land has produced rapid and large escalation of land values, to the extent that the use of large areas of land for parking automobiles and other vehicles is uneconomical from the standpoint of monetary return. Unfortunately, the very commercialization which enhances the land values creates an increased demand for vehicle parking space. It is obvious, therefore, that optimum economic usage of the land can only be achieved through the use of multistory parking garages.

One example of such a garage is shown in U.S. Pat. No. 3,330,083 of Jaulmes, the garage comprising a multistory structure of parking cells to which vehicles are delivered by an elevator which is movable both vertically and laterally. Automobiles are driven onto the elevator which then carries the car to an empty cell into which the car is driven by an attendant. Retrieval of a car requires the attendant to go to the designated parking cell and to drive the car onto the elevator. Other examples of such structures are shown in U.S. Pat. Nos. 1,815,429 of Canady; 2,948,421 of Smith et al and 4,664,580 of Matoba.

In the interests of both economy and safety, it is preferable to eliminate the necessity of parking attendants handling the cars by automating the parking operation. There are numerous examples in the prior art of such automated garages, such as that shown in U.S. Pat. No. 4,264,257 of Saurwein. The Saurwein patent discloses a circular parking tower having an elevator with a turntable floor. A shuttle mechanism normally carried on the elevator moves under the car to be parked, lifts it up, and carries it on to the elevator. At the parking cell, the shuttle carries the car into the cell, deposits it, and returns to the elevator. The entrance ramp supports the car wheels on a plurality of spaced fingers which interdigitate with fingers on the shuttle so that the shuttle fingers pass through the ramp fingers to lift the car off of the ramp. A similar mechanism enables the shuttle to deposit the car in a cell or to lift the car out of a cell. A similar interdigitated finger arrangement is shown in U.S. Pat. No. 3,618,793 of Coursey. In both the Saurwein and Coursey arrangements, the apparatus for moving the vehicle is both complicated and costly, and must be capable of bearing the full weight of the car. Thus, automation is achieved, but a the cost of an expensive investment in heavy and complex machinery.

In these automated arrangements, the full weight of the car is borne by the transfer or shuttle mechanism, necessitating heavy, relatively expensive, and complicated mechanisms. There have been efforts to reduce complexity and expense in handling cars, as exemplified in U.S. Pat. Nos. 2,994,445 of Roth and 1,803,583 of Aitken. In the Roth patent, a system is shown wherein the vehicle is driven onto an elevator adjacent to an endless belt conveyor having followers mounted thereon. In one embodiment, the followers engage lugs on a wheeled dolly upon which the car rests to move the dolly, and hence the car, into a parking cell. In another embodiment, the followers engage the automobile wheels to impel the unbraked automobile into or out of the parking cell. In the Aitken patent, a parking device consisting of a movable shuttle having rotatably powered lugs for engaging one wheel of the car impels the car into or out of a parking cell. Both the Roth and Aitken arrangements are much simpler than other devices in the prior art, and are not required to bear the full weight of the car. However, both operate on but a single wheel of the car, thus placing undue stress on the car's suspension system, and both engage the tire of the wheel, thereby creating the risk of damage to the tire. In addition, the mechanical linkage involved in the Aitken arrangement is quite complicated. A similar arrangement is shown in U.S. Pat. No. 4,690,611 of Nobukara, in which metallic fingers on a carriage engage a downwardly extending lug on the bottom of the wheeled vehicle. The arrangement requires that any vehicle to be moved have one or more downward extending lugs affixed to the underside thereof, which requirement prevents the parking of automobiles off the street.

In U.S. Pat. No. 2,428,856 of Sinclair, there is shown an arrangement utilizing a carriage having a pair of upwardly extending arms which engage the front and rear bumpers of the vehicle, thus causing it to move with the carriage. Such an arrangement, in which the rigid areas positively bear against the vehicle, can cause damage to the vehicle, especially where the vehicle has no rigid, transverse bumpers. Another arrangement utilizing a carriage is shown in U.S. Pat. No. 2,113,986 of Kent, wherein coupling the carriage to the vehicle is achieved by a large electromagnet, which is quite expensive, or by actual physical engagement of the carriage with an operative part of the vehicle, such as the differential housing, which can result in damage to the vehicle.

In all of the arrangements of the foregoing prior art a degree of complexity exists which entails undue expense, wear, or as pointed out, possible damage to the running gear of the vehicle being parked. Thus, while much of the prior art achieves automation to at least some degree, it is at the sacrifice of economy, both in the structure and maintenance of such arrangements or of the protection of the vehicle from damage.

SUMMARY OF THE INVENTION

The present invention, through its unique vehicle transport mechanism, achieves a high degree of automation in a relatively simple and economical manner.

In one preferred embodiment of the invention a multistory parking garage is formed in a manner similar to that shown in U.S. Pat. No. 4,664,580 of applicant, having four inner vertical structural members arranged in a square configuration defining a central core or elevator shaft, and first and second pairs of outer vertical structural members, defining the outer ends of diametrically opposed parking cells. The outer members are joined to each other and to the inner members by substantially horizontal joist members, the joists defining the discrete floors of the multistory structure. A floor pan is mounted between pairs of joists at each floor level for supporting vehicles thereon. Each floor pan is designed with tracks for a vehicle defined by a pair of raised spaced guides.

An elevator is constrained to move vertically within the central core, and the floor of the elevator has a pair of raised spaced guides defining vehicle tracks on the elevator floor and a guide space between the pair of guides. The spacing of the guides is the same as the spacing of the guides on the floor pan of each parking cell so that when the elevator floor is flush with a parking cell floor, the vehicle tracks and the guide space are substantially continuous throughout the length of the parking cell and elevator. Mounted on suitable rollers within the guide space on the elevator floor is a vehicle carriage which is movable between the elevator floor and the parking cell.

The underside of virtually all automotive vehicles is extremely irregular, since much of the automobile equipment, such as mufflers, drive shaft, transmission, differential, and chassis cross braces are grouped within the space between the longitudinal frame members of the chassis. The present invention utilizes these irregularities to move the vehicle. To this end, there are mounted on the carriage a plurality of resilient, inflatable members, which, when inflated, intrude into the irregular shapes and cavities on the underside of the vehicle substantially conforming to the underside topography of the vehicle and thereby effectively connecting the carriage to the vehicle so that when the carriage moves, the unbraked vehicle moves with it. The resilient nature of the inflatable members minimizes the possibility of any damage to the vehicle or its components, while the carriage, driven by suitable propulsion means, applies movement force to the vehicle substantially along the centerline thereof. Thus the vehicle may be moved, on its own wheels, from the elevator to the parking cell or vice versa. Once the vehicle is deposited in a parking cell, the resilient members are deflated and the carriage returns to the elevator. In retrieving a vehicle from the parking cell, the carriage with resilient members deflated is moved from the elevator to a position under the vehicle. The members are then inflated and the vehicle is rolled onto the elevator.

In a second preferred embodiment of the invention, the resilient inflatable members are used to raise and lower a resilient traction pad which engages and substantially conforms to the topography of the underside of the vehicle. The traction pad may be a pillow shaped member partially filled with a suitable fluid so that it readily moves into engagement with the irregularities and cavities on the underside of the vehicle.

DESCRIPTION OF THE DRAWINGS

FIG. 4 is a diagram of the air supply system for inflatable elements of the present invention;

FIG. 5 is a perspective view of a portion of the vehicle transport mechanism of the invention;

FIGS. 6*a* and 6*b* are partial elevational views illustrating the operation of a feature of the invention;

FIG. 7 is a cross-section of a modification of the platform 58 of FIG. 5;

DETAILED DESCRIPTION

Figure 1:
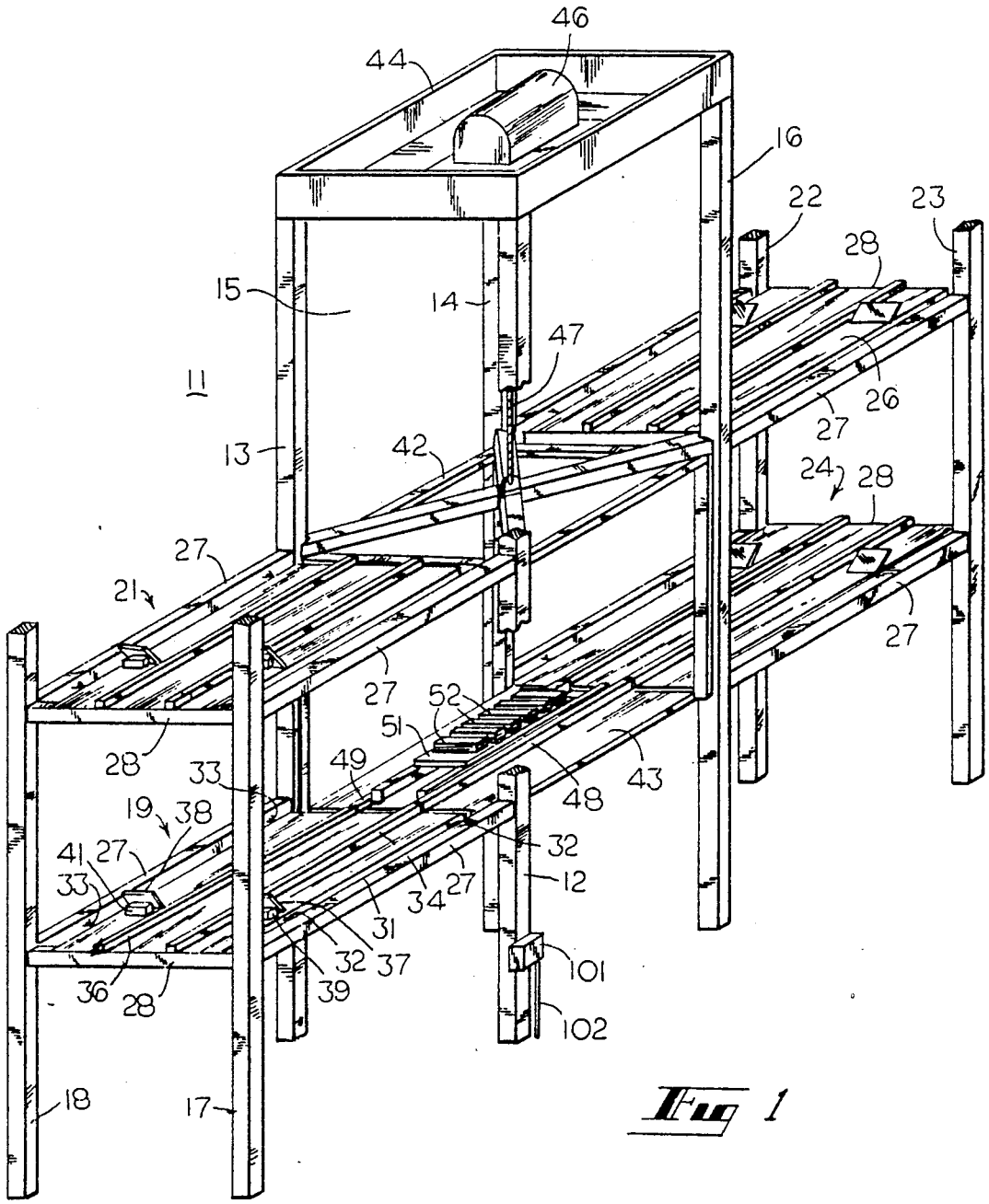
FIG. 1 is a perspective view of a multilevel parking garage of the present invention.

FIG. 1 depicts a multistory parking garage 11 embodying the principles and features of the present invention. While the garage 11 of FIG. 1 is shown as having only two parking levels, it is to be understood that the unique design permits several parking levels, e.g., eight, ten or twelve or more, depending upon the demand for parking in the particular locale. In the following discussion, because certain structural features of the present invention are the same or similar to corresponding features in the multistory garage which is the subject of U.S. Pat. No. 4,664,580 of the present applicant, frequent reference will be made to the disclosure of that patent, hence the disclosure of that patent is herein incorporated by reference.

Garage 11 comprises four inner pillars or vertical columns 12, 13, 14, and 16 formed of, for example, structural steel box columns. Inner columns 12, 13, 14, and 16 define a square inner core space 15 which functions as an elevator shaft. Spaced from columns 12 and 13, and defining a plane parallel to the plane defined by columns 12 and 13, is a first pair of columns 17 and 18, which define the outer end of the parking cells 19 and 21. In a like manner, a second pair of columns 22 and 23 are spaced from inner columns 14 and 16 and define the other end of parking cells 24 and 26. Columns 17 and 18 are joined to the corresponding inner columns 12 and 13 respectively, by structural joist members 27—27 and to each other by structural joist members 28—28. Columns 22 and 23 are joined in the same manner to each other and to the corresponding inner columns. For simplicity, the remainder of the discussion of FIG. 1 is directed to a single cell 19, it being understood that the remaining cells 21, 24 and 26 are the same in all respects as cell 19.

Figure 2:
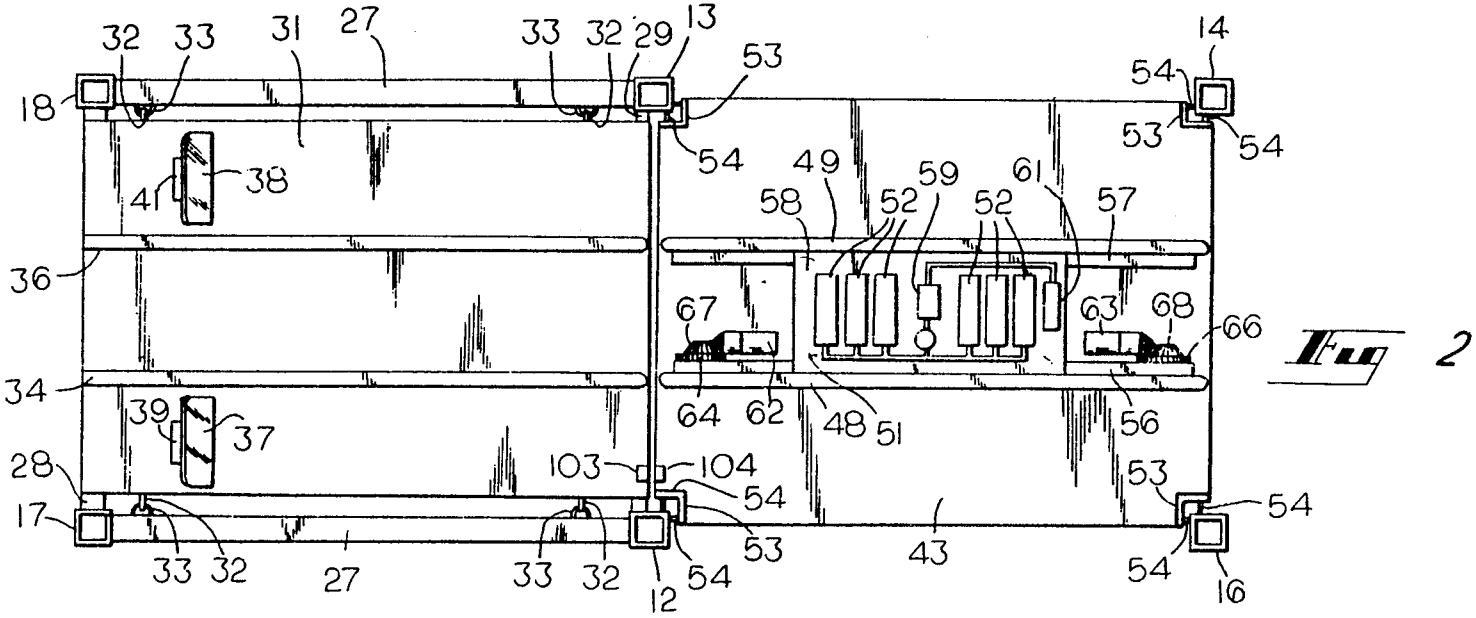
FIG. 2 is a plan view of the elevator floor and a parking cell floor embodying the present invention.
Figure 3B:
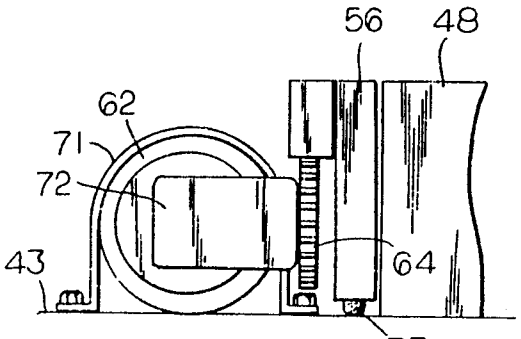
FIGS. 3*a* and 3*b* are a side and end elevational view, respectively, of a portion of the vehicle transport system of the present invention.
Figure 3A:
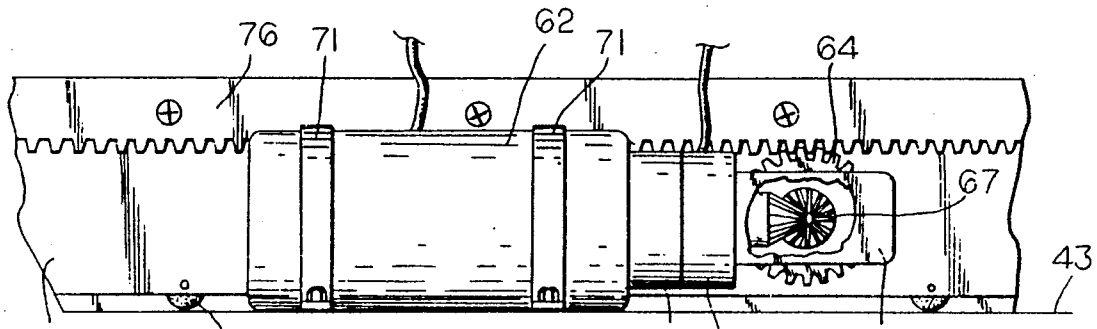
Figure 9A:
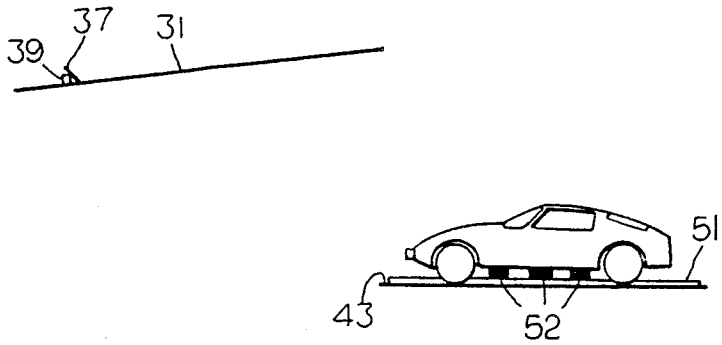
FIGS. 9*a* through 9*e* are a series of line drawings depicting the sequence of operation of the present invention.
Figure 9B:
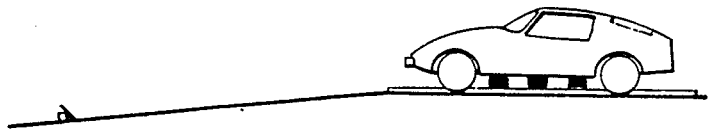
Figure 9C:
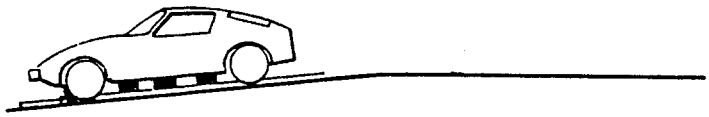
Figure 9D:
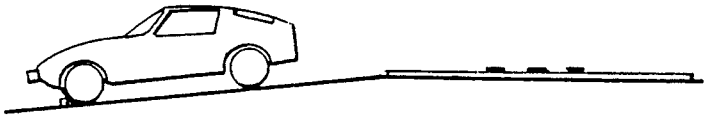
Figure 9E:
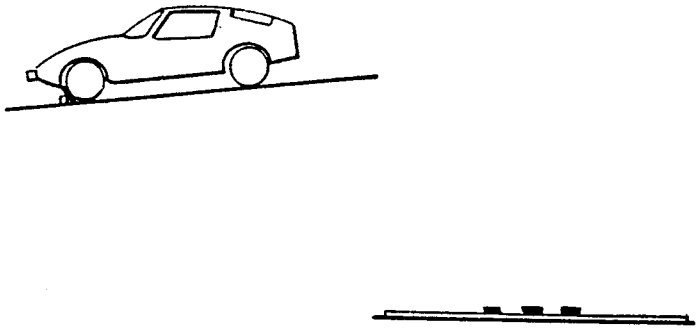

Supported in cell 19 by joists 27—27, 28, and a joist 29, best seen in FIG. 2, connected between columns 12 and 13, is a floor pan 31. The ends of floor pan 31 rest upon joists 28 and 29, and, intermediate its ends, the pan 31 is supported by wire rope members 32—32 strung between joists 27—27 and supported therefrom by eyebolts or other suitable means 33—33 in the manner shown in U.S. Pat. No. 4,664,580. Floor plan 31 is designed to bear the weight of a single vehicle, and, to this end, wire rope or cable members 32—32 are made of approximately $\frac{3}{4}$ inch stranded steel cable. Pan 31 may be made of any suitable material having sufficient strength to bear the weight of the vehicle, such as, for example, 5 mm thick high strength, low carbon steel sheet.

Mounted on floor pan 31 intermediate the sides thereof are first and second longitudinal wheel guide members 34 and 36 extending the length of pan 31. Members 34 and 36 may also be made integral with pan 31 by forming ridges therein, as shown in U.S. Pat. No. 4,664,580. Members 34 and 36 are spaced from each other a distance equal to the spacing between the inner tire walls of the narrowest gauge vehicles, such as subcompact cars, and function to prevent the vehicle from deviating from a substantially straight line as it enters or leaves the parking cell. A pair of chocks 37 and 38 function to prevent the vehicle from rolling too far. As will be explained hereinafter, chocks 37 and 38 are spring loaded and capable of a slight amount of movement, sufficient to actuate limit switches 39 and 41 mounted behind them. The function of limit switches 39 and 41 will be explained more fully hereinafter. To ensure that the wheels of the vehicle bear against the chocks 37 and 38, cell 19, including joists 27—27, 28 and 29 is constructed so that there is an approximate one degree slope from front to rear, that is, from the end of the cell adjacent the elevator core or shaft downward to the end adjacent columns 17 and 18. The one degree slope also ensures that in the event of a malfunction of the vehicle carriage, to be discussed hereinafter, the vehicle will tend to remain in, or will return to, the parking cell.

Within the central core space formed by members 12, 13, 14 and 16 is an elevator cage which, with the exception of elevator floor 43 is substantially identical to the elevator cage disclosed in U.S. Pat. No. 4,664,580, but, in the present embodiment, is dimensioned to handle a single vehicle instead of a pair of side by side vehicles. Also in the manner disclosed in that patent, there is mounted on the top of columns 12, 13, 14, and 16 a machinery cell 44 containing the necessary motors and machinery, shown schematically as 46 for raising and lowering elevator cage 42 by means of elevator suspension means 47, shown schematically as a cable.

Mounted on floor 43 of elevator 42 is a pair of wheel guide members 48 and 49 which are spaced from each other the same distance as guides 34 and 36 in cell 19, so that when the elevator floor 43 is flush with floor pan 31, members 48 and 49 form, with guides 34 and 36, respectively, a continuous uninterrupted wheel guide pair extending across elevator floor 43 and the length of floor pan 31. Movably mounted between guides 48 and 49 is a vehicle carriage member 51 having mounted thereon a plurality of resilient, inflatable members 52—52 for engaging the underside of the vehicle to be transferred, either from the elevator to the cell, or vice versa.

FIG. 2 is a plan view showing in more detail the relationships of the various components of floor pan 31 and elevator floor 43. Elevator 42 is constrained to move in a vertical direction by means of L-shaped angle members 53—53 which form the vertical corner members of cage 42 and which have mounted therein roller members 54—54 which bear against the column members 12, 13, 14, and 16. This is the same arrangement as is used in U.S. Pat. No. 4,664,580 wherein it is explained in greater detail. Located between guides 48 and 49 is a carriage member 51 which comprises first and second longitudinal members 56 and 57 upon which is mounted a platform 58. Mounted on platform 58 is a plurality of resilient inflatable members 52, a compressed air tank 59 and air compressor 61, and air conduits leading to each of the members 52. As will be discussed in greater detail hereinafter, carriage 51, which is mounted on rollers, not shown, is made to move by first and second electric motors 62, 63 of, for example, approximately 2 horsepower which drive pinion gears 64 and 66, respectively, through a gear reduction unit and bevel gear assemblies 67 and 68, respectively. Mounted on members 56 is a rack, not shown, which meshes with pinions 64 and 66 to impel carriage 51 toward or away from cell 19.

Referring now to FIGS. *3a* and *3b*, there is shown a partial elevation view and end view of the drive means for moving carriage 51. The drive means comprises a reversible d.c. motor 62 of approximately 2 horsepower mounted to the floor 43 of the elevator 42 and held in place by suitable means, such as straps 71—71. A bevel gear assembly 67, contained in a gear box 72, is driven by motor 62 through a reduction gear assembly 73 and a clutch member 74 which preferably is of the magnetic type. Bevel gear assembly 67 drives pinion gear 64 which meshes with an elongated rack 76 mounted on longitudinal member 56. Member 56 is made movable over floor 43 by means of a plurality of rollers 77—77. When motor 62 is turned on and clutch 74 engaged, pinion 64 is rotated, thereby imparting to rack 76 and hence member 56 longitudinal movement. Member 56 is slightly spaced from guide 48 but may occasionally rub against it. Normally if the contacting surfaces are well oiled or greased there is no problem since friction is minimized. If desired, rollers or other type bearings may be mounted on member 56 to bear against the adjacent surface of guide 48. As will be apparent hereinafter, since floor 31 of cell 19 preferably has a slope of one degree, as pointed out heretofore, as carriage 51 is driven into cell 19, it reaches a point where it departs from level travel to a one degree downhill travel. With the gearing arrangement shown in FIGS. *3a* and *3b*, this poses no problem since the pinion 64 will remain in engagement with the rack 76 regardless of the angular orientation thereof. Other gearing arrangements may be used other than that shown in FIGS. *3a* and *3b*, however, in some instances it may be necessary to accommodate the change in angular orientation of the carriage 51 to ensure that the driving gears remain properly engaged throughout.

As shown in FIG. 2, a second drive motor 63 and gearing 66 and 68 is provided for moving the carriage 51 toward and away from the cell opposite cell 19. Normally, one motor is sufficient to drive carriage 51, hence, in operation, when motor 62 is driving carriage 51, the magnetic clutch on motor 63 is disengaged. Thus, as carriage 51 is driven into cell 19, rack 76 disengages from pinion 66. When carriage 51 is retrieved from cell 19, rack 76 readily re-engages with pinion 66, since pinion 66 is in an idler mode. Re-engagement may be facilitated by the provision of a slight taper at the extreme end of rack 76. As an alternative to the use of a second motor, a single motor may be used and be connected to pinion 66 by means of universal couplings and a drive shaft.

FIG. 4 is a schematic view of a preferred arrangement for inflating and deflating the resilient members 52—52, which comprises a compressed air tank 59 connected through a regulator valve 81 to air hoses 82 and 83. Air hoses 82 and 83 are connected through two-way valves 84 and 86 to the individual members 52—52, each of which is provided with a manual shut-off valve 87. Shut-off valves 87—87 make it possible to remove one or more of the members 52 from operation without closing down the entire system. Thus, if one of the members 52 springs a leak at, for example, a peak load time, it can be cut out of the system and subsequently replaced during a slack period. Valves 84 and 86 normally prevent air from tank 59 from reaching and inflating members 52—52. When members 52—52 are to be inflated, valves 84 and 86 are opened and the compressed air from tank 59 rapidly inflates the members 52—52. When inflated members 52—52 are to be deflated, valves 84 and 86 are actuated to close the lines 82 and 83 so that air from tank 59 can no longer reach members 52—52, and at the same time air from members 52—52 is directed to line 88, which is connected to compressor 61. Compressor 61 acts as a suction pump on its inlet or line 88 side, to speed the deflation process, and delivers the air back to tank 59 through line 91. When it is necessary to replenish the air in tank 59, compressor inlet valve 89 is opened and compressor 61 draws air from the outside, compresses it, and delivers it through the line or hose 91 to tank 59. It is to be understood that compressor 61 includes an electric motor, not shown, which can be, for example, approximately 2 horsepower. The air pressure of the compressed air may be, for example, approximately 22–25 psi, which ensures rapid inflation of the members 52—52.

In order that the entire operation of the system may be automatic, the valves are preferably electrically controlled, along with the motors and the magnetic clutches, and are supplied with actuating signals or current from a programmed control center, member 101 in FIG. 1, which is connected through suitable wiring, not shown, to the various electrical components. Power for center 101 and for the electrical components, including elevator motor 46, is supplied through cable 102 from a suitable power source.

The operation of the carriage 51 and the manner in which it engages and disengages with a vehicle can best be understood with reference to FIGS. 5, *6a* and *6b*. As can be seen in FIGS. 1 and 2, the resilient inflatable elements 52 are arranged in groups. A preferred form of one such group is shown in perspective in FIG. 5, and comprises nine elements 52. Each element 52 comprises a hollow accordion pleated member of steel or nylon reinforced resilient material, such as, for example, Buna rubber, having a wall thickness of approximately $\frac{1}{8}$ inch. Other resilient materials, such as rubber impregnated nylon or fiberglass can also be used provided such material can permit rapid inflation and deflation and still be able to resist punctures and tears. While nine elements 52—52 ar shown in the group of FIG. 5, more or fewer may be used, in any of a variety of configurations and shapes.

In FIG. *6a*, a rough profile of the underside of an automobile has been shown, with the car resting on its wheels on floor 43, having been driven onto the elevator at the ground level or at some loading and unloading level and left in position with the brakes off and the car in neutral with the engine turned off. The elements 52—52, as shown in FIG. *6a*, are deflated, just prior to actuation of the valves 84 and 86. When valves 84 and 86 are opened compressed air flows from tank 59 into each of the elements 52—52, producing the result shown in FIG. *6b*. As can be seen in FIG. *6b*, the elements 52—52 have inflated to where they bear against the underside of the car, substantially conforming to the topography thereof and at least partially filling the irregularities as shown. The pressure of the air from tank 59 is sufficient to inflate elements 52—52 and cause them to bear firmly against the underside of the car, but is not great enough to lift the car. As a consequence, the car remains standing on its unbraked wheels, but is held firmly in place on carriage 51. When carriage 51 moves, the car will move with it, rolling on its wheels but remaining attached to carriage 51.

The inflatable members 52 are shown in FIG. 5 as being partially inflated, but in FIG. *6a* they are shown as being almost totally deflated. When totally deflated the height of carriage 51 above the floor is approximately eight inches, which allows the carriage to pass under virtually any present day vehicle. However, as vehicles are made lower and lower, a point may be reached where there is insufficient clearance for members 52—52. In this event, the platform 58 may be provided with an indented or recessed portion 92 in which members 52—52 are carried as shown in FIG. 7, which lowers the effective height of members 52—52 and hence the effective height of carriage 51. In addition, it can be seen that the group of elements 52—52 does not extend entirely across, but occupies approximately the center half of the platform 58. This is done to provide clearance for certain suspension components, e.g., coil springs, which extend substantially lower than the remainder of the components and frame on the underside of the vehicle. In present day automobiles, components of the body shell at the front of the car are often lower than the underside of the car, but hardly ever at the rear of the car. Thus it may be necessary to back the car onto the elevator, or to use a carriage in which the platform 58 has recessed portions 92—92, to ensure proper clearance for carriage 51.

In operation, when a vehicle has been driven onto the elevator floor at the loading-unloading level, straddling carriage 51, and left in neutral with the brakes and engine off, operation is initiated by an operator at control box 101. Valves 84 and 86 are opened and members 52 are inflated, as shown in FIG. *6b*. The elevator lift mechanism then raises the elevator until the elevator floor is flush with the floor of an empty cell, as signaled by suitable sensors 103 and 104 in FIG. 2. The signal from sensors 103 and 104 is passed to control box 101 by suitable means, not shown, which then stops the lift mechanism 46. When the elevator has stopped, control box actuates magnetic clutch 74 and motor 62, causing carriage 51 to move the vehicle into the parking cell until the wheels thereof encounter chocks 37 and 38, actuating limit switches 39 and 41. The signal from switches 39 and 41 causes the control box to close valves 84 and 86, thereby deflating members 52—52 through hose 88 and vacuum pump 61. Motor 62, which was stopped by the control box is reversed, and the carriage withdrawn back onto the elevator floor. Since the one degree slope of the cell floor ensures that the wheels of the vehicle remain against chocks 37 and 38, thereby holding switches 39 and 41 in their actuated position as long as the vehicle remains parked in the cell, switches 39 and 41 continuously signal the control box that that particular cell is occupied.

Figure 8:
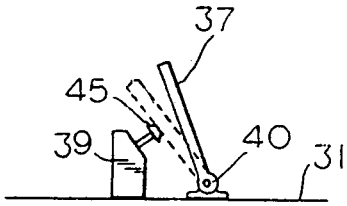
FIG. 8 is a side elevational view of a detail of the present invention.

In FIG. 8 there is shown a chock and switch arrangement in which chock 37 is hingedly mounted to floor 31 by means of a spring loaded hinge 40 which normally holds chock 37 in the position shown by solid lines. When the vehicle wheel encounters chock 37, it is forced back to the position indicated by the dashed lines, causing it to depress switch actuator 45 which actuates the limit switch 39.

When it is desired to retrieve a vehicle from a cell, the elevator is sent to the cell, the motor drives the carriage into the cell under the vehicle, members 52—52 are inflated, the motor reversed, and the vehicle is rolled out of the cell onto the elevator floor. The elevator then descends to the ground level, members 52—52 are deflated and the vehicle driven out of the elevator.

The parking sequence described in the foregoing is illustrated by a series of line drawings *9a* through *9e*. The sequence for removing a vehicle from a cell is basically the reverse of that shown in FIGS. *9a* through *9e*.

Figure 10:
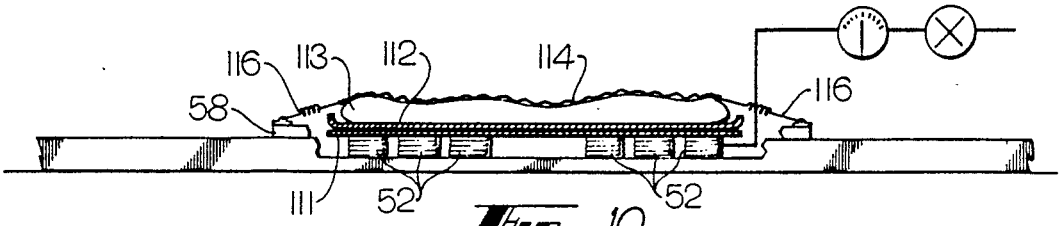
FIG. 10 is a partial elevation view of the modified vehicle engaging apparatus of the second preferred embodiment of the invention.

In FIG. 10 there is shown a second preferred embodiment of the invention wherein the carrier mechanism is modified to prevent the inflatable members from engaging the undersurface of the vehicle. As seen in FIG. 10, the array of inflatable members 52,52 supports a flat plate 111 to which they are attached. Plate 111 may be of any suitable material, but is preferably steel. Bolted or otherwise removably affixed to plate 111 is a second plate 112 upon which is disposed an elongated hollow pillow shaped traction pad 113 which is preferably made of a heat resistant flexible material such as, for example, nylon or fiberglass, impregnated with rubber. Pad 113 is partially filled with a suitable liquid, such as water or oil, or it may be partially inflated with a suitable gas. The ends and sides of plate 112 are curved upwardly so that plate 112 can retain any liquid that might leak from pad 113.

Figure 11:
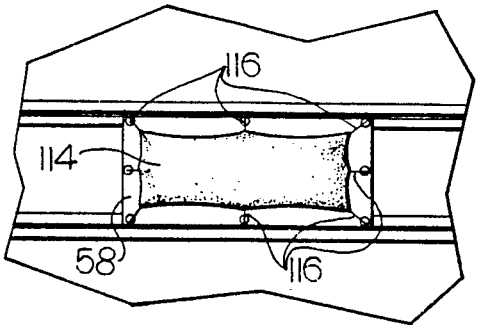
FIG. 11 is a partial plan view of the apparatus of FIG. 10.

Pad 113 is retained in position on plate 112 and protected from direct contact with the underside of a vehicle by a sheet 114 of heat resistant flexible material, such as fiberglass, which overlays pad 113 and is attached to platform 58 by means of spring loaded stays 116,116, best seen in FIG. 11. Sheet 114 is sufficiently resilient to follow the contours of pad 113.

Figure 12:
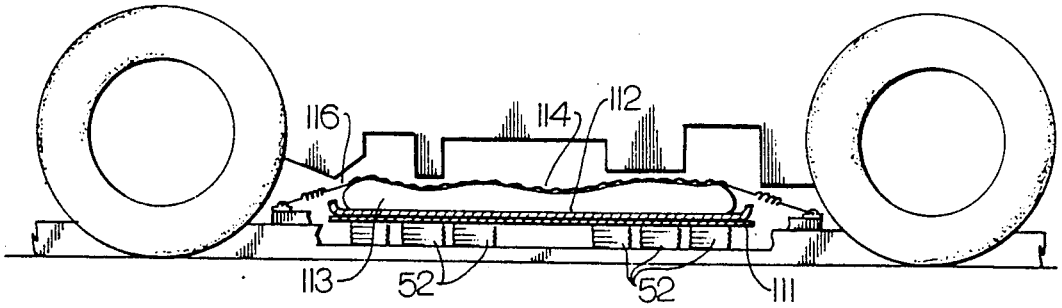
FIG. 12 is an elevation view of the apparatus of FIG. 10, disengaged from the vehicle.
Figure 13:
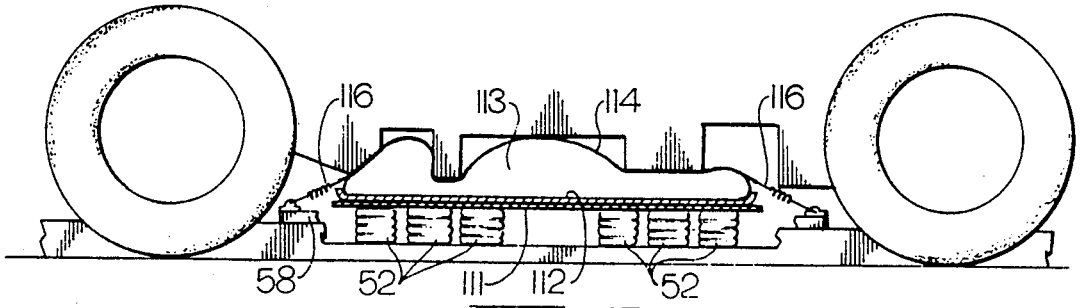
FIG. 13 is an elevation view of the apparatus of FIG. 10, engaged with the vehicle.

In operation, as best seen in FIGS. 12 and 13, a vehicle is disposed over carriage 51, with members 52, 52 uninflated. After the vehicle is in position, members 52, 52 are inflated, raising plates 111 and 112 and pad 113, until pad 113 engages and substantially conforms to the topography of the underside of the vehicle, as best seen in FIG. 13, thus joining the vehicle to carriage 51 so that it moves therewith.

The arrangement of FIGS. 10 through 13 protects members 52, 52 from damage, either mechanical or thermal, and substitutes a traction pad 113, itself protected by sheet 114, for engaging the vehicle. A traction pad, such as pad 113, is much easier to replace and is cheaper than a plurality of accordion pleated members 52, 52.

While inflatable members 52, 52 are used to raise and lower traction pad 113, it is possible, where space is not at a premium, to use, for example, a jack screw in lieu of members 52,52.

In both embodiments of the invention as thus far discussed, the link between the vehicle and the carriage is achieved through use of a resilient member or members which press against the underside of the vehicle. The resilience prevents in large measure any damage to the vehicle, the possibility of which, as pointed out heretofore, typifies the prior art arrangements.

The foregoing is illustrative of preferred embodiments of the invention and is in no way intended to be limiting. The principles of the invention may be readily extended to handling of two vehicles side by side, or to handling four vehicles by making the elevator two stories high. Thus the cruciform shape shown in U.S. Pat. No. 4,664,580 could be used by having the bottom floor of the elevator rest below ground in, for example, a pit while the top elevator level was loaded, then raising the elevator to bring the bottom floor level to the ground for loading. In addition, it will be readily apparent to those skilled in the art that the vehicle carriage mechanism could be readily adapted for use in prior art structures, such as the circular structure of Saurwein. Additionally, the tracks and carriage mechanism could be mounted on a turntable on the elevator floor, thus permitting use of, for example, a cruciform shaped garage. Various other modifications and changes may occur to persons skilled in the art without departure from the spirit and scope of the invention.

I claim:

1. For use in a multistory parking garage having a vehicle loading first floor and a plurality of other floors, floored parking cells on the other floors, and an elevator mechanism having an elevator floor for transporting wheeled vehicles from the first floor to the other floors and wherein the wheeled vehicles have an irregular underside topography, a vehicle transport mechanism for moving a vehicle from the elevator into a parking cell and for moving a vehicle from a cell to the elevator, said transport mechanism comprising a carriage member movable in a substantially linear path along the elevator floor and the floor of the parking cell, said carriage member being adapted to be moved under the vehicle between the wheels thereof, engaging means mounted on said carriage member for resiliently engaging the underside of the vehicle, said engaging means being adapted to substantially conform to the irregular underside topography of the vehicle to be moved, and means for moving said carriage into and out of a parking cell comprising drive means mounted on the elevator floor and means mounted on said carriage member adapted to engage with said drive means.

2. A multistory vehicle parking garage for parking wheeled vehicles having an irregular underside, said garage comprising, in combination:

a plurality of interior vertical members defining an elevator shaft;

an elevator member having a floor adapted to move in a vertical direction within said shaft;

a plurality of exterior vertical members in parallel spaced relationship to said interior members;

a plurality of floor defining members connected between said interior and exterior members defining a plurality of vehicle storage cells;

each of said storage cells having a vehicle bearing floor member extending between pairs of said floor defining members with one end adjacent said elevator shaft and another end adjacent said exterior members;

at least one pair of parallel guide members on said vehicle bearing floor;

at least one pair of parallel guide members on said floor of said elevator adapted to align with the said guide members on each of said vehicle bearing floor members when said elevator floor and said vehicle bearing floor are in alignment;

a vehicle transport mechanism adapted to be carried on said elevator between the said parallel guide members;

said vehicle transport mechanism having mounted thereon resilient means for engaging and substantially conforming to the irregular underside of a vehicle between the wheels thereof when the vehicle is being transported by said elevator;

said vehicle transport mechanism being adapted to move from between the said guide members on said elevator floor to a position between said guide members on each said vehicle bearing floor when said elevator floor is aligned with said vehicle bearing floor;

means for moving said vehicle transport mechanism comprising an electrically driven pinion gear, and a rack mounted on said transport mechanism adapted to be driven by said pinion; and means for raising and lowering said elevator.

* * * * *